US008490436B2

(12) United States Patent
Chung et al.

(10) Patent No.: US 8,490,436 B2
(45) Date of Patent: Jul. 23, 2013

(54) CIRCULAR KNITTED FABRIC WITH FINISHED EDGES AND INTEGRAL ELASTIC BAND-LIKE SELVEDGE AND THE METHOD OF MANUFACTURING THE SAME

(75) Inventors: Chi Leung Chung, Hong Kong (HK); King Hung Andrew Ko, Hong Kong (HK); Ka Chun Wan, Hong Kong (HK)

(73) Assignee: Pacific Textiles Limited, Hong Kong (HK)

( * ) Notice: Subject to any disclaimer, the term of this patent is extended or adjusted under 35 U.S.C. 154(b) by 32 days.

(21) Appl. No.: 13/279,353

(22) Filed: Oct. 24, 2011

(65) Prior Publication Data

US 2012/0036897 A1 Feb. 16, 2012

Related U.S. Application Data

(63) Continuation-in-part of application No. 12/044,974, filed on Mar. 9, 2008, now Pat. No. 8,069,692.

(51) Int. Cl.
*D04B 1/18* (2006.01)

(52) U.S. Cl.
USPC ..... 66/172 E; 66/172 R

(58) Field of Classification Search
USPC ..... 66/172 E, 174, 171 R, 202, 17 R
See application file for complete search history.

(56) References Cited

U.S. PATENT DOCUMENTS

| | | | | | |
|---|---|---|---|---|---|
| 2,578,889 | A | * | 12/1951 | Kennedy | 66/147 |
| 2,811,029 | A | * | 10/1957 | Conner | 66/172 R |
| 3,796,066 | A | * | 3/1974 | Millar | 66/95 |
| 3,996,771 | A | * | 12/1976 | Routh et al. | 66/147 |
| 4,133,191 | A | * | 1/1979 | Blore et al. | 66/197 |
| 4,534,819 | A | * | 8/1985 | Payet et al. | 156/515 |
| 4,750,339 | A | * | 6/1988 | Simpson et al. | 66/172 R |
| 5,239,846 | A | * | 8/1993 | Kitaura et al. | 66/174 |
| 6,212,914 | B1 | * | 4/2001 | Kolmes et al. | 66/172 R |
| 6,230,524 | B1 | * | 5/2001 | Kolmes et al. | 66/172 R |
| 6,367,290 | B2 | * | 4/2002 | Kolmes et al. | 66/172 R |
| 6,588,237 | B2 | * | 7/2003 | Cole et al. | 66/202 |

* cited by examiner

*Primary Examiner* — Danny Worrell

(57) ABSTRACT

A circular knitted fabric for the manufacture of a garment includes a first group of courses formed of a low melting point yarn and a first yarn, and a continuing second group of courses formed of the low melting point yarn and a second yarn. The second group of courses has an elastane content greater than that of the first group of courses. The low melting point yarn fuses with the first and second yarns after heating to a temperature sufficient to melt the low melting point yarn only. The fabric, after finishing, is adapted to be cut into a garment in such a way that the first group of courses becomes a body or the first group of courses of the garment, and the second group of courses becomes an integral elastic band portion or the second group of courses-like selvedge of the garment.

18 Claims, 6 Drawing Sheets

CIRCULAR KNITTED FABRIC WITH FINISHED EDGES AND INTEGRAL ELASTIC BAND-LIKE SELVEDGE AND THE METHOD OF MANUFACTURING THE SAME

CROSS REFERENCE OF RELATED APPLICATION

This application is a continuation-in-part of U.S. patent application Ser. No. 12/044,974, entitled "Circular Knitted Fabric with Finished Edges and Integral Elastic Band-like Selvedge and the Method of Manufacturing the Same", filed on Mar. 8, 2008, now has been patented under U.S. Pat. No. 8,069,692, the entire content of which is hereby incorporated by reference.

FIELD OF PATENT APPLICATION

The present patent application relates to a circular knitted fabric that has an integral elastic band-like selvedge for a garment, and a method of manufacturing the circular knitted fabric.

BACKGROUND

Most garments are made by cutting fabric into pattern pieces and then sewing the cut pattern pieces together to make the garment. Typically, each cut pattern piece has one or more edges that are sewn to the edges of one or more adjacent cut pattern pieces, thereby forming seams between cut pattern pieces. The outer edges of the garment, however, are not sewn to the edges of other cut pattern pieces. As a result, the outer edges are exposed to forces that may fray or tear the fabric. In response to the tearing and fraying problem, the clothing industry has developed methods for finishing the edges of garments, including using narrow elastics, laces, trims and/or folded over edges.

The most common method for finishing the edges of a cut pattern piece involves using narrow elastics. Referring to FIG. 1, a cut pattern piece A may be made of cotton, nylon, polyester, or spandex fibers or any other natural or synthetic fibers commonly used to make garments. The cut pattern piece A has an outer edge B and includes a plurality of fibers C having free ends D that terminate at the edge B. As is well known to those skilled in the art, the free ends D of the fibers C form a rough, outer edge that tends to fray and/or tear as the fabric is used.

In order to overcome the above-mentioned fraying and tearing problems in garment, most cut pattern pieces have narrow elastics that are sewn onto the outer edges of the cut pattern pieces. Referring to FIGS. 2A-2C and 3A-3C, a cut pattern piece A has a rough, outer edge B with fibers having ends (not shown) that terminate at the edge. Referring to FIGS. 2A and 3A, a narrow elastic S is aligned over a top surface C of the cut pattern piece A. Referring to FIGS. 2B and 3B, a flap F of fabric adjacent outer edge B is folded over the top surface C, and the narrow elastic S is positioned over the flap F. Referring to FIGS. 2C and 3C, the flap F and the narrow elastic S are held in place by stitching N to form a finished edge on the cut pattern piece A. The finished edge, including the flap S and the narrow elastic S, has a thickness T1 that is substantially greater than the thickness T2 of the cut pattern piece A itself. As a result, the finished edge is more bulky and is likely to be visible through outerwear.

As noted above, in most garments, finished edges are made using narrow elastics. In some garments, however, finished edges are made using laces, fold-over edges, or trims, with or without using narrow elastics. The presence of bulky edges, as shown in FIGS. 2 and 3, are not desirable, particularly when the pattern pieces are used for producing undergarments. The reason is that bulky finished edges add undesirable bulkiness to the undergarment and they can be seen through clothing worn over the undergarments. Additionally, the undesirable bulky finished edges often have rougher surfaces which tend to cause discomfort to a wearer.

Subsequently, the textile industry has developed a kind of fabric that can be cut freely without having the fraying and tearing problem. Although the fabric does not need binding to keep its edges from fraying and tearing, narrow elastics and trims are still needed in the garment manufacturing stage because the fabric does not provide the grip that is needed in certain style of garment. For example, if such fabric with finished edges is used in a panty style garment, a narrow elastic or other binding method is still needed to create a tighter grip in the waist opening of the garment, and bulky finished edges still exist even with the use of fabric with finished edges.

To further overcome the above-mentioned problems, the clothing industry has also developed a type of fabric having knitted-in edges, whereby relatively complex stitching is formed at the edges to prevent fraying and tearing, and provide sufficient grip to the fabric. Although garments having knitted-in edges are smoother than garments using narrow elastics, laces and/or trims, they are more expensive. This is because a knitted-in edge requires complex knitting that increases the cost of making the fabric and involves warp-knitting construction that requires higher handling and setup costs. Such statement holds true because warp knitting machinery costs more than circular knitting machinery. Furthermore, the production and preparation involved in warp knitting cost much more than those of circular knitting because more production procedures are involved. Additionally, one warp knitting production setup often produces a larger quantity of fabric and that requires a customer to bear a larger minimum order in quantity. Such minimum order requirement is often not desirable for undergarment production because orders of undergarment are often placed in smaller quantity because of small pieces used in these garment styles.

Besides the higher handling cost of manufacturing fabric with knitted-in edges, this type of warp knit fabric is limited to be knitted with synthetic fiber only. Although synthetic based fabric is used in the current clothing industry, the fabric is known to be less "breathable", has a relatively low moisture absorption rate, and only offers artificial hand feel. Such properties are not particularly desirable in the undergarment industry because undergarments are worn next to the skin where the natural touch of fabric is crucial for maximizing the comfort of a wearer. With the market being more and more eco-conscious nowadays, natural/cellulose fiber based fabric is widely sorted after not only for its natural touch but also for the natural way the raw material is produced.

In view of the above-described problems, there is a need for garments having finished outer edges that are not bulky and do not show through outer garments. There is also a need for methods of making garments that improve material yield and reduce waste. There is also a need for garments having finished outer edges that provide enough grip to a wearer's body. Furthermore, there is also a need for a type of fabric that can solve the above-mentioned problems and is cellulose-based.

The above description of the background is provided to aid in understanding the cellulose-based circular knitted fabric and the method of manufacturing the fabric disclosed in the present patent application, but is not admitted to describe or constitute pertinent prior art.

SUMMARY

The present patent application is directed to a cellulose-based circular knitted fabric for the manufacture of a garment. The cellulose-based circular knitted fabric includes a first group of courses formed of a low melting point yarn and a first yarn. The cellulose-based circular knitted fabric also includes a continuing second group of courses formed of the low melting point yarn and a second yarn. The second group of courses has an elastane content greater than that of the first group of courses. The low melting point yarn fuses with the first and second yarns after heating to a temperature sufficient to melt the low melting point yarn only. The fabric, after finishing, is adapted to be cut into a garment in such a way that the first group of courses becomes a body of the garment, and the second group of courses becomes an integral elastic band-like selvedge of the garment.

The present application is also directed to a method of manufacturing a circular knitted fabric for a garment. The method includes the steps of: knitting a low melting point yarn with a first yarn to form a first group of courses of the fabric; continuously knitting the low melting point yarn with a second yarn to form a second group of courses of the fabric; and heating the fabric to a temperature sufficient to melt the low melting point yarn only so that it fuses with the first and second yarns.

Although the cellulose-based circular knitted fabric and the method of manufacturing the fabric of the present application are shown and described with respect to certain embodiments, it is evident that equivalents and modifications will occur to others skilled in the art upon the reading and understanding of the specification.

DETAILED DESCRIPTION

It should be understood that the fabric and the method of manufacturing the fabric are not limited to the illustrated embodiments described below and that various changes and modifications thereof may be effected by one skilled in the art without departing from the spirit or scope of the disclosure and the appended claims. For example, elements and/or features of different illustrative embodiments may be combined with each other and/or substituted for each other within the scope of this disclosure and appended claims.

The term "low melting point yarn" as used herein means a heat fusible yarn having a melting point which is relatively lower than that of the other yarns knitted together on the same fabric.

The term "integral elastic band-like selvedge" as used herein means a finished edge of a garment that works like an elastic band but is integrally formed in the fabric rather than attached to the fabric in a separate process after the knitting process.

Figure 1:
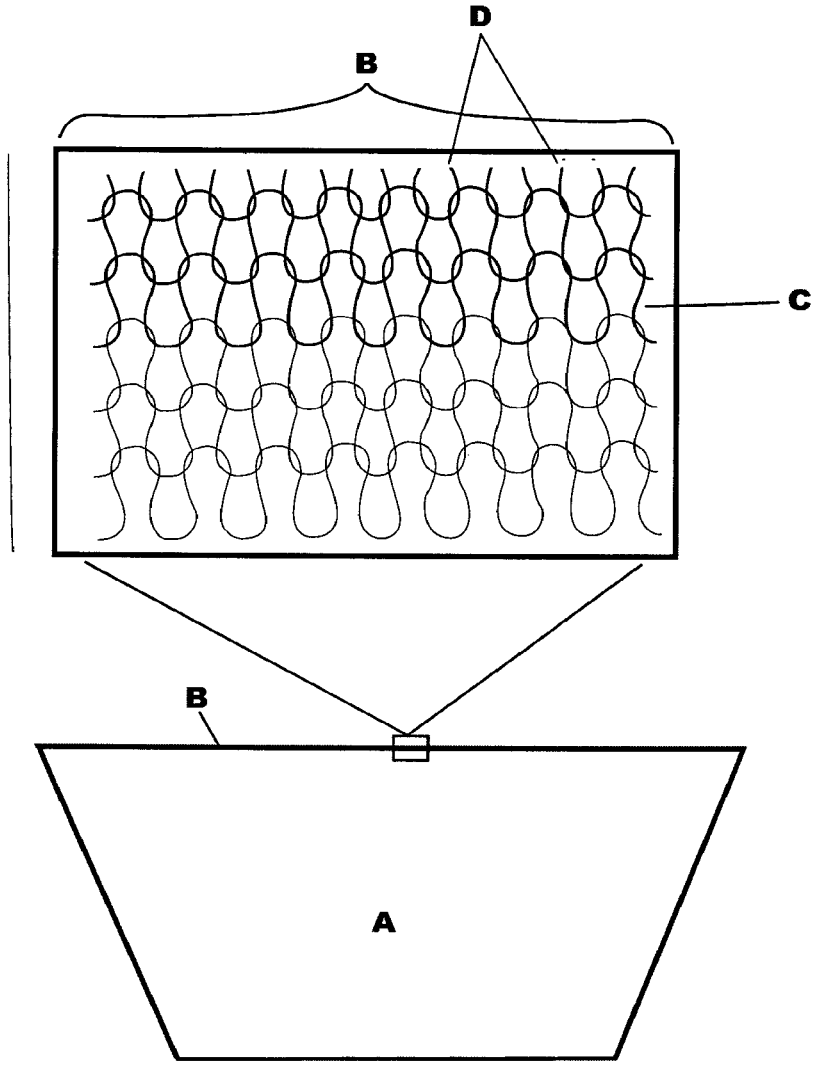
FIG 1 Prior Art
FIG. 1 is a top plan view of a cut pattern piece used to manufacture garments and an enlarged view of an edge of the cut pattern piece according to the prior art.
Figure 2A:
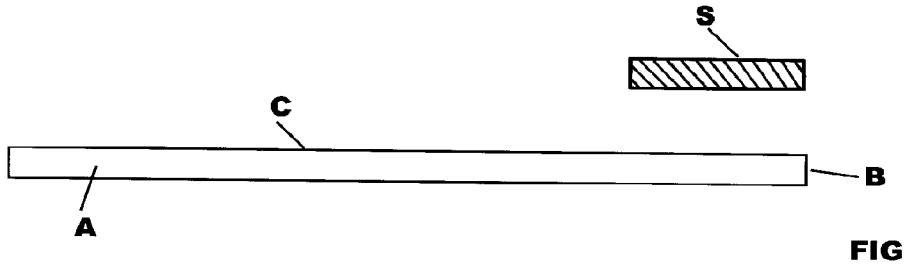
FIG 2A PRIOR ART
FIGS. 2A, 2B and 2C are cross sectional views showing the steps of sewing a narrow elastic onto an edge of the cut pattern piece according to the prior art.
Figure 2B:
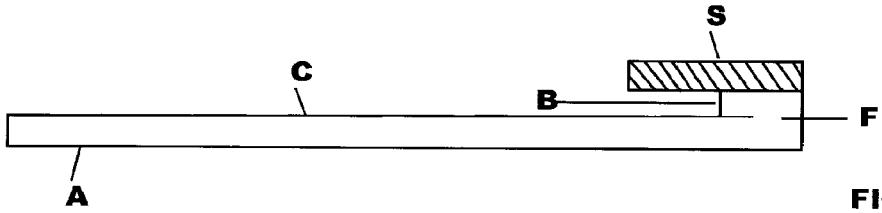
FIG 2B PRIOR ART
Figure 2C:
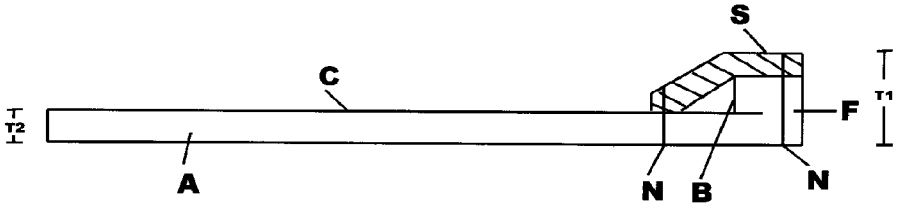
FIG 2C PRIOR ART
Figure 3A:
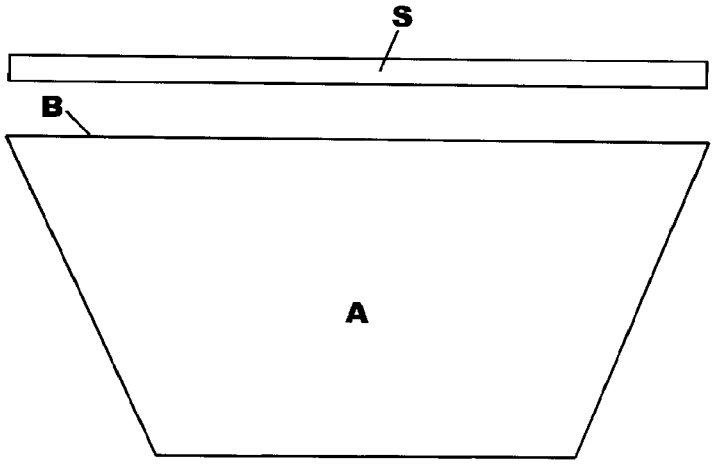
FIG 3A PRIOR ART
FIGS. 3A-3C are top plan views showing the steps of sewing the narrow elastic onto the edge of the cut pattern piece, as illustrated in FIGS. 2A, 2B and 2C.
Figure 3B:
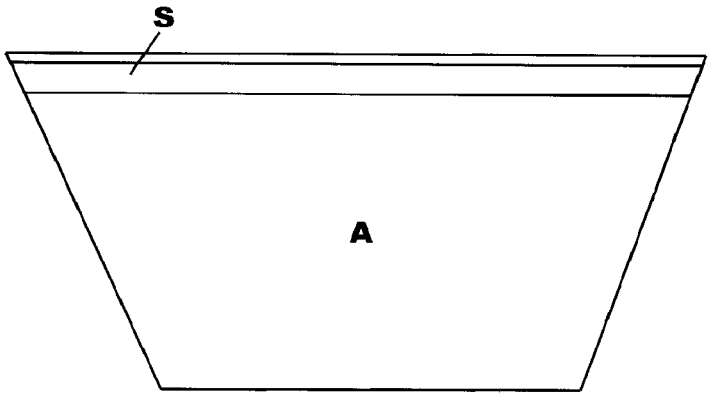
FIG 3B PRIOR ART
Figure 3C:
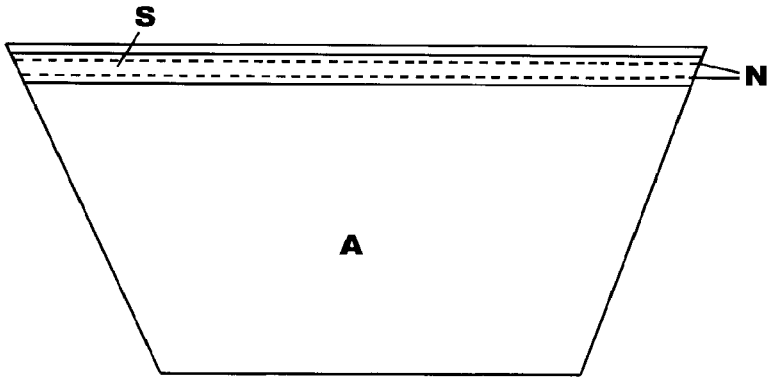
FIG 3C PRIOR ART
Figure 4:
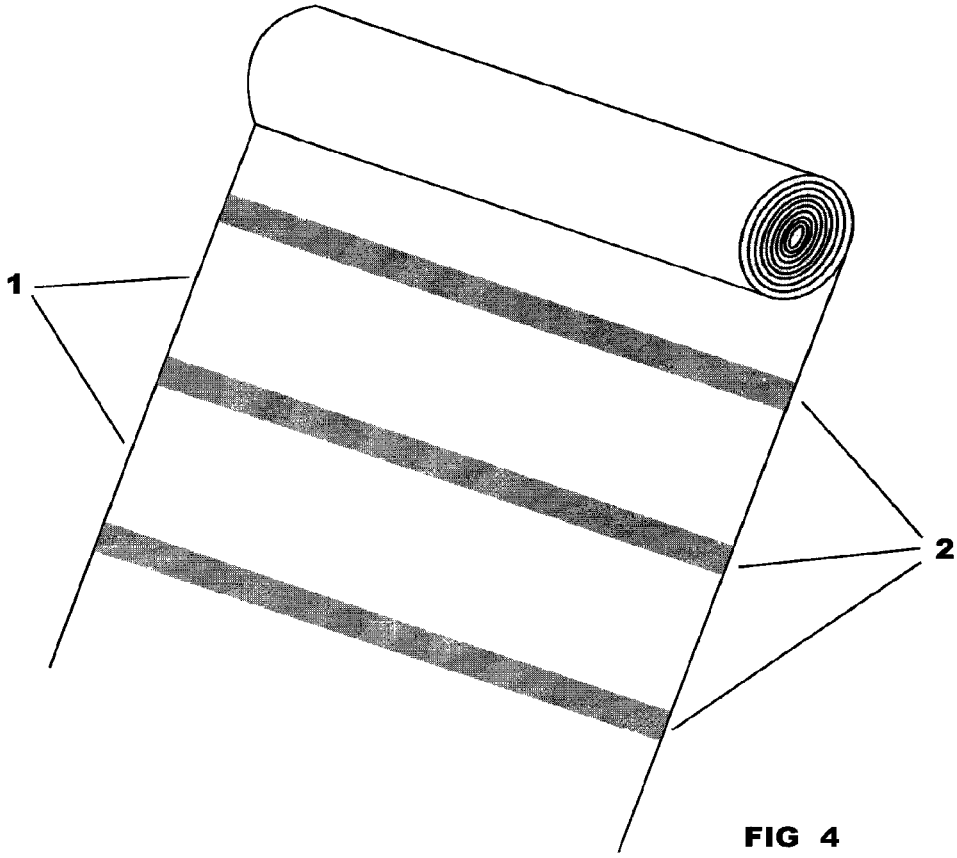
FIG. 4 shows two differently constructed parts knitted on the same piece of fabric according to an embodiment of the present application.

FIG. 4 shows two differently constructed parts knitted continuously on the same piece of fabric according to an embodiment of the present application. One part of the fabric is utilized as a body or a first group of courses 1, and another part of the fabric is utilized as a knitted-in elastic band or a second group of courses 2. The method of manufacturing the fabric can be realized by control over raw material selection, knitting construction, and finishing process. Through the selection of raw material, one can opt for the best combination of yarns that can provide the required stretch, modulus and recovery on different parts of the fabric.

Figure 5A:
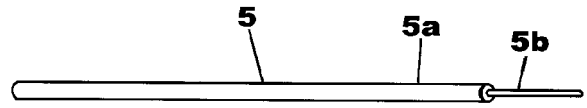
FIGS. 5A, 5B and 5C show three types of raw material, namely core-spun elastane, bare elastane, and cellulose yarn respectively.
Figure 5B:
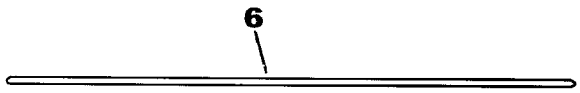
Figure 5C:
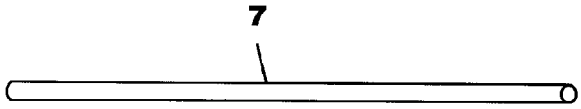

FIGS. 5A, 5B and 5C show three types of raw material that may be used, namely core-spun elastane 5 (FIG. 5A), bare elastane 6 (FIG. 5B), and cellulose yarn 7 (FIG. 5C) respectively. Although three types of raw material are shown, it is understood by one skilled in the art that other suitable raw materials may also be used. For example, synthetic fiber such as Nylon and polyester yarn may be used instead of cellulose yarn.

When a fabric is manufactured with finished edges, the free ends of the yarns need to be bonded together and/or to the fabric when it is cut. To achieve that, one may utilize a type of elastane that has a relatively low melting point and use it as an adhesive agent to bond the free ends of the yarns.

Figure 7A:
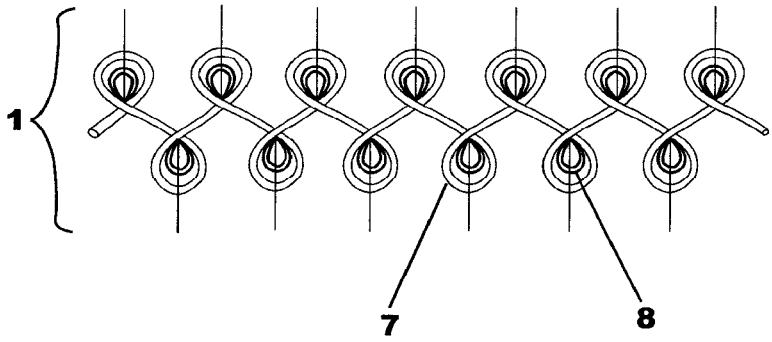
FIGS. 7A and 7B are enlarged views of the first group of courses and the second group of courses of FIG. 6.
Figure 7B:
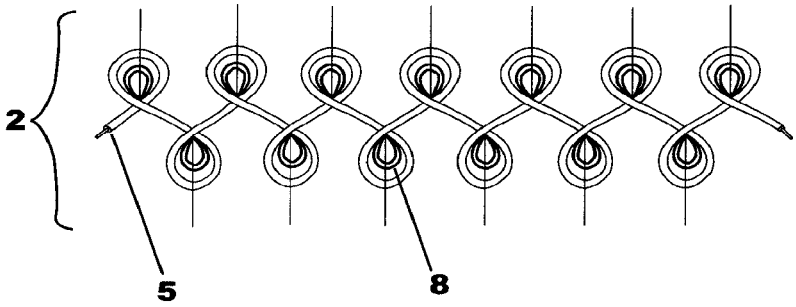

According to the illustrated embodiment, a low melting point elastane 8 is knitted in all loop formation on the fabric and has a smaller size and diameter than those of the core-spun elastane 5, bare elastane 6, and cellulose yarn 7, as depicted in FIGS. 7A and 7B. The body or the first group of courses 1 of the fabric may be a combination of cellulose yarn 7 and low melting point elastane 8. The elastic band or the second group of courses 2 of the fabric may have a higher stretch, modulus, and recovery than the body or the first group of courses 1 of the fabric. Such function calls for the use of core-spun elastane 5.

As shown in FIG. 5A, core-spun elastane 5 is a type of elastane that has a layer of cellulose fiber 5*a* wrapping around a core 5*b*. The core-spun elastane 5 has a similar hand feel of a cellulose fiber but it also provides a much higher stretch and modulus than conventional cellulose yarns. By utilizing the combination of core-spun elastane 5 and low melting point elastane 8, one can render the elastic band or the second group of courses 2 of the fabric to have an elastane content that is greater than that of the body or the first group of courses 1 of the fabric. As a result, the knitted-in elastic band or the second group of courses 2 can have a much higher modulus and recovery, and can provide the grip that is needed in garment manufacturing and allow it to be utilized as an elastic band or the second group of courses 2 in the garment.

Figure 6:
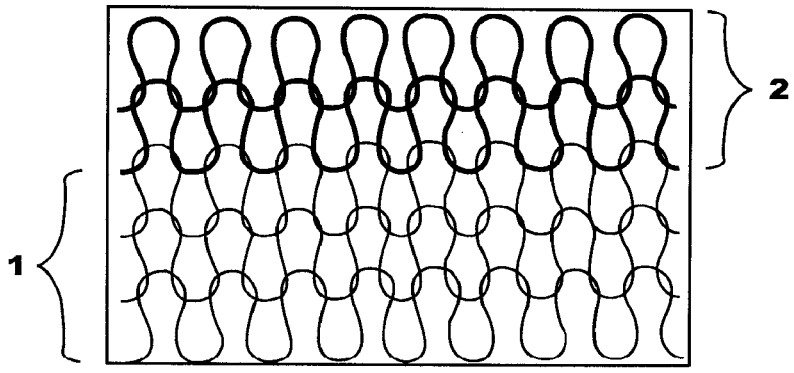
FIG. 6 shows a typical loop formation with a first group of courses and a second group of courses of the fabric according to an embodiment of the present application.

FIG. 6 shows a typical loop formation with the body or the first group of courses 1 and the knitted-in elastic band or the second group of courses 2. The knitting construction dictates how the raw materials are distributed on the fabric.

FIGS. 7A and 7B are enlarged views of the body or the first group of courses 1 and the knitted-in elastic band or the second group of courses 2 of the knitting construction of FIG. 6. The body or the first group of courses 1 is knitted with both cellulose yarn 7 and low melting point elastane 8. The knitted-in elastic band or the second group of courses 2 is knitted with both core-spun elastane 5 and low melting point elastane 8. The low melting point elastic yarn 8 is knitted in all loop formation throughout the fabric, and is in direct contact with the cellulose yarn 7 and core-spun elastane 5 used on the fabric. When the low melting point elastane 8 is heated and fused with the cellulose yarn 7 and core-spun elastane 5 during the finishing process, the low melting point elastane 8 serves as a binding agent for preventing the free ends of the yarns from raveling when the fabric is cut after finishing The cellulose yarn 7 and the core-spun elastane 5, having a relatively high melting point, do not melt during the heat treatment. After finishing, the fabric can be cut into a garment in such a way that the body or the first group of courses 1 becomes a body of the garment and the elastic band or the second group of courses 2 becomes an integral elastic band-like selvedge of the garment.

A knitting machine can be adjusted to produce different knit patterns that suit different garment size ratio (XS, S, M, L or XL). The knitting of the elastic band or the second group of courses 2 and the body or the first group of courses 1 can be repeated, and the lengths of the elastic band portion or the second group of courses 2 and the continuing body or the first group of courses 1 can be adjusted. Such adjustment can minimize the loss of raw materials and increase the yield of fabric for garment making. It is appreciated that the length of the elastic band or the second group of courses 2 is shorter than the length of the body or the first group of courses 1 so that the longer body or the first group of courses 1 can be cut and form a main body of a garment and the shorter elastic band or the second group of courses 2 can be cut and form an integral elastic band-like selvedge of the garment.

Additionally, the fabric can be knitted in such a way that the technical front and back of the fabric can have the same amount of cellulose yarn and elastane yarn (FIGS. 7A and 7B). Because of the equal distribution of yarns, the fabric may not suffer from curling problem when the fabric is stretched.

The finishing process facilitates the fusing of the highly heat sensitive elastic yarn by the application of heat of an optimized temperature. Such finishing process allows the raw materials on the fabric to be bound together and subsequently allows the fabric to be cut in all direction without any raveling ends that are prone to tearing and fraying. This is because the free ends of the yarns are bound to the fabric and the yarns will not easily become loose. The bond between the fused low melting point elastane and the fabric is rather strong and can sustain up to about 20 times commercial washing with tearing problem. Additionally, the finishing process allows one to optimize and fine-tune the elasticity of the body or the first group of courses 1 and the elastic band or the second group of courses 2 of the fabric.

Figures 8A, 8B, 8C:
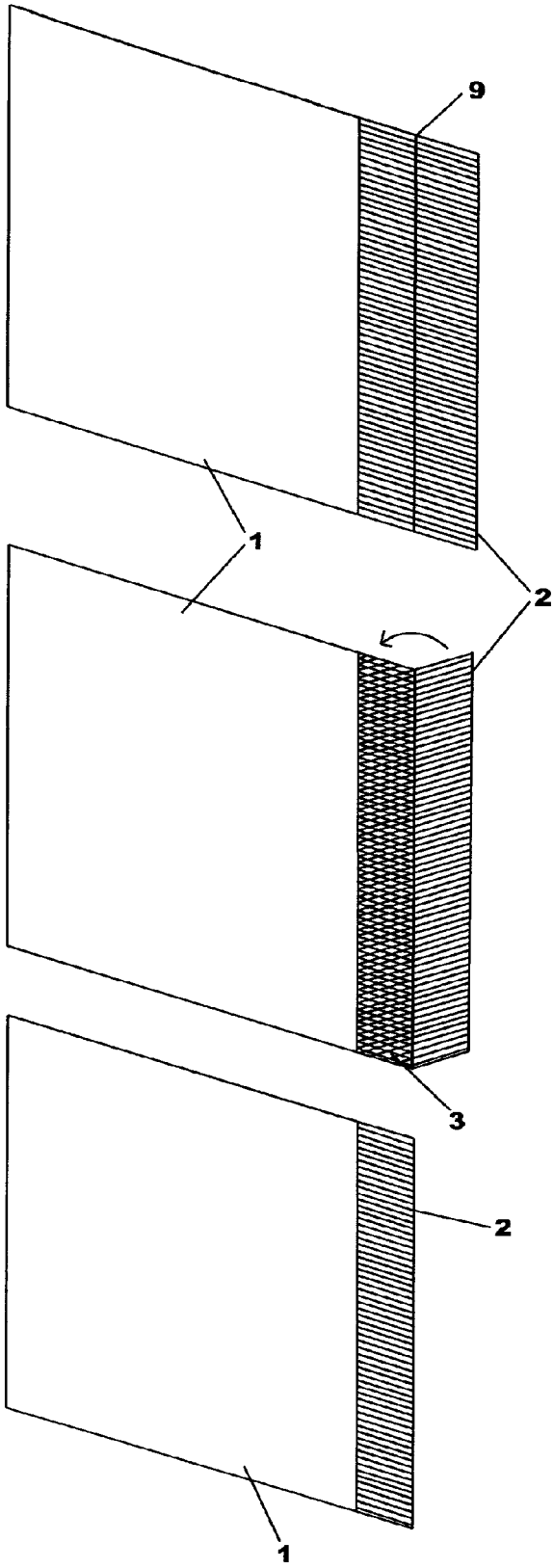
FIGS. 8A, 8B and 8C show the steps of manufacturing a folded elastic band according to an embodiment of the present application.

FIGS. 8A, 8B and 8C show the steps of manufacturing a folded elastic band according to an embodiment of the present application. When a specific garment fashion requires a stronger elastic band, the manufacturer can knit up a foldable integrated elastic band that can be utilized as a stronger elastic band. Referring to FIG. 8A, the manufacturer can knit up an elastic band 2 with a longer length and with a fold line 9 in the middle of the elastic band around the circular knitted fabric. The manufacturer can then apply adhesive 3 on one surface of the elastic band 2, as illustrated in FIG. 8B, and fold the elastic band 2 in half along the fold line 9, and adhere the folded halves of the elastic band together, as depicted in FIG. 8C. A folded elastic band with two layers can have a strength twice as strong as an elastic band with only one layer. A folded elastic band can offer a different option for the garment designers to choose from. Although it has been described that the two folded halves are adhered together by adhesive, it is understood by one skilled in the art that other appropriate methods, such as heat fusion, may be used.

Currently in the market, there are fabrics with finished edges for the manufacture of undergarments such as panties. Although the fabrics are made with finished edges, the panties so formed still require separate elastic bands to be bound to the waist opening The use of the cellulose based circular knitted fabric disclosed in the present application allows garment designers and manufacturers to design and manufacture panties that require fewer seams thereby maximizing the comfort of a wearer. Additionally, the use of the circular knitted fabric disclosed in the present application allows garments to be made with a less bulky design and edges that are less likely to be visible through outer garments and yet provide the same type of grip and support as those made by conventional binding methods.

As far as manufacturing process is concerned, the method disclosed in the present application allows the garment manufacturers to lower their production cost in several ways. With the finished edges and integrated waistband, garment-manufacturing efficiency can be enhanced because the manufacturing process requires less energy, less time, and less manpower. Moreover, the method disclosed in present application allows garments to be made with less components. The garment manufacturers no longer need to bear the wastage of elastic and fabrics that normally follows after the garment manufacturing process.

While the circular knitted fabric and method of manufacturing the fabric have been shown and described with particular references to a number of preferred embodiments thereof, it should be noted that various other changes or modifications may be made without departing from the scope of the appended claims.

What is claimed is:

1. A circular knitted fabric for the manufacture of a garment, the fabric comprising:

a first group of courses formed of a low melting point yarn and a first yarn; and a continuing second group of courses formed of the low melting point yarn and a second yarn, the second group of courses having an elastane content greater than that of the first group of courses, wherein:

the low melting point yarn fuses with the first and second yarns after the fabric is heated to a temperature sufficient to melt the low melting point yarn only, and the fabric, after finishing, is adapted to be cut into a garment in such a way that the first group of courses becomes a body of the garment and the second group of courses becomes an integral elastic band like selvedge of the garment; and the second group of courses is folded along a fold line around the circular knitted fabric, and the folded courses are adhered together by an adhesive.

2. The fabric as claimed in claim 1, wherein the first yarn is cellulose yarn.

3. The fabric as claimed in claim 1, wherein the second yarn is core-spun elastane.

4. The fabric as claimed in claim 1, wherein the length of the second group of courses is shorter than the length of the first group of courses.

5. The fabric as claimed in claim 1, wherein the low melting point yarn is knitted in loop formation.

6. The fabric as claimed in claim 1, wherein the technical front and back of the fabric have the same amount of first/second yarn and low melting point yarn.

7. An undergarment made from the circular knitted fabric as claimed in claim 1.

8. A garment made at least in part from the circular knitted fabric as claimed in claim 1.

9. A method of manufacturing a circular knitted fabric for a garment, the method comprising the steps of:

knitting a low melting point yarn with a first yarn to form a first group of courses of the fabric;

continuously knitting the low melting point yarn with a second yarn to form a second group of courses of the fabric;

heating the fabric to a temperature sufficient to melt the low melting point yarn only so that it fuses with the first and second yarns; and folding the second group of courses along a fold line around the circular knitted fabric, and adhering the folded portions together by an adhesive.

10. The method as claimed in claim 9, further comprising the step of repeating steps of knitting a low melting point yarn with a first yarn to form a first group of courses of the fabric and the step of continuously knitting the low melting point yarn with a second yarn to form a second group of courses of the fabric before the step of heating the fabric to a temperature sufficient to melt the low melting point yarn only so that it fuses with the first and second yarns.

11. The method as claimed in claim 9, further comprising the steps of cooling the fabric after the step of heating the fabric to a temperature sufficient to melt the low melting point yarn only so that it fuses with the first and second yarns, and cutting the fabric into a garment in such a way that the first group of courses becomes a body of the garment and the second group of courses becomes an integral elastic band like selvedge of the garment.

12. The method as claimed in claim 9, wherein the low melting point yarn is knitted in loop formation.

13. The method as claimed in claim 9, wherein the first yarn is cellulose yarn.

14. The method as claimed in claim 9, wherein the second yarn is core-spun elastane.

15. The method as claimed in claim 9, wherein the second group of courses has an elastane content that is greater than that of the first group of courses.

16. The method as claimed in claim 9, wherein the length of the second group of courses is shorter than the length of the first group of courses.

17. The method as claimed in claim 9, wherein the technical front and back of the fabric have the same amount of first/second yarn and low melting point yarn.

18. A garment made at least in part by the method as claimed in claim 9.

* * * * *